US006283899B1

(12) United States Patent
Charnitski

(10) Patent No.: US 6,283,899 B1
(45) **Date of Patent: *Sep. 4, 2001**

(54) INERTIAL RESISTANCE EXERCISE APPARATUS AND METHOD

(76) Inventor: Richard D. Charnitski, 25601 Adriana St., Mission Viejo, CA (US) 92691

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/899,964

(22) Filed: Jul. 24, 1997

(51) Int. Cl.[7] ..... A63B 23/025

(52) U.S. Cl. ..... 482/110; 482/99; 482/102; 482/106; 482/120; 482/137; 482/148

(58) Field of Search ..... 482/110, 99, 102, 482/106, 120, 127, 148

(56) References Cited

U.S. PATENT DOCUMENTS

| | | | | |
|---|---|---|---|---|
| 196,435 | | 10/1877 | Clifford . | |
| D. 231,242 | | 4/1974 | Herrmann et al. . | |
| 684,688 | | 10/1901 | Herz . | |
| 770,994 | * | 9/1904 | White | 482/110 |
| 786,552 | * | 4/1905 | Duffner | 482/110 |
| 1,869,673 | * | 8/1932 | Duff | 482/110 |
| 3,737,162 | | 6/1973 | Wood . | |
| 3,841,627 | * | 10/1974 | Vetter | 482/110 |
| 4,003,575 | | 1/1977 | Hobbs . | |
| 4,077,626 | | 3/1978 | Newman . | |
| 4,231,568 | | 11/1980 | Riley et al. . | |
| 4,328,965 | * | 5/1982 | Hatfield | 482/127 |
| 4,422,636 | | 12/1983 | de Angeli . | |
| 4,844,450 | | 7/1989 | Rodgers, Jr. . | |
| 4,953,854 | | 9/1990 | Pizur, Sr. . | |
| 4,953,855 | | 9/1990 | Shields . | |
| 5,242,351 | | 9/1993 | Berg et al. . | |
| 5,399,136 | | 3/1995 | Bart . | |
| 5,509,878 | | 4/1996 | Denega et al. . | |

FOREIGN PATENT DOCUMENTS

| | | | | |
|---|---|---|---|---|
| 30 11 404 A1 | | 10/1981 | (DE) . | |
| 3011404 | * | 10/1981 | (DE) | 482/94 |
| 3042430 | * | 6/1982 | (DE) | 482/110 |
| 0611623 | * | 6/1978 | (SU) | 482/102 |
| 1405856 | * | 6/1988 | (SU) | 482/102 |

* cited by examiner

*Primary Examiner*—Jerome W. Donnelly
(74) *Attorney, Agent, or Firm*—Knobbe, Martens, Olson & Bear, LLP

(57) ABSTRACT

An exercise apparatus and method utilizes a flywheel mounted on a rotatable axle. The user exercises by accelerating and decelerating the rotation of the flywheel. For example, a line which wraps around the axle provides a mechanism for accelerating and decelerating the flywheel when a user applies a pulling force to the line. The inertia of the flywheel resists the user applied pulling force and provides the exercise mechanism. Preferably, spool mounted on the axle and variable pivot locations provide a mechanism for easily varying the exercise resistance.

13 Claims, 13 Drawing Sheets

INERTIAL RESISTANCE EXERCISE APPARATUS AND METHOD

BACKGROUND

It is a well known form of exercise to create a resistance to muscular contraction or elongation. Exercise producing resistance may be provided by free weights, i.e., barbells or plates attached to a bar, or machines utilizing, for example, weight stacks, compressed air, hydraulics, magnets, friction, springs, bending flexible rods, rotating fan blades, mechanical dampers or the users own body weight. A conventional exercise with free weights, for example, involves a "positive" movement in which the muscle under training is contracting to lift a weight and a "negative" movement in which that muscle is elongating to lower the weight. Many exercise machines emulate the exercise movements used in free weight training.

There are many disadvantages to exercising with both free weights and these conventional exercise machines. For instance, free weights are potentially hazardous without a partner to "spot" the user, and it is difficult and time consuming to adjust the amount of weight to be used in order to perform a different exercise or to accommodate another person of differing strength. Various exercise machines tend to be heavy and/or bulky and do not offer the intensity, range-of-movement and variety of movement of free weights. Also, both free weights and weight machines cannot be used in a gravity-free environment, such as encountered by astronauts.

An alternative form of exercise utilizes inertia to provide exercise-producing resistance. Such exercise is based on the principle that force is required to rotationally accelerate a mass, i.e., to increase or decrease the rotational velocity of a mass. An inertial exercise device has several advantages over both free weights and conventional exercise machines. Less bulk is required because the difficulty of the exercise depends not only on mass but also on the angular acceleration of mass. No partner is required as with free weights. Further, an inertial exercise device does not require gravity.

Existing exercise devices utilizing inertia, however, suffer from several disadvantages. Many such devices provide only a positive work exercise. Further, it is often difficult to vary the resistance of inertial exercises. Finally, unlike free weights or some exercise machines, existing inertia-based exercise devices have difficulty providing a constant resistance and/or constant speed of movement.

SUMMARY

The present invention relates to an exercise apparatus and method in which exercise-producing resistance is provided by the inertia of a rotatable mass. One aspect of this invention employs a flywheel which is axially mounted to a rotatable axle. One end of a line is attached to the axle. In an initial position, a portion of the line is wrapped about a portion of the axle. A user applying a force to the unattached end of the line creates an accelerating torque on the axle, causing the axle to begin rotating and the line to begin unwrapping. As the user increases the force on the line, the axle and flywheel rotate with increasing velocity. When the line is completely unwrapped from the axle, inertia causes the axle to continue rotating in the same direction. This continued rotation of the axle causes the line to wrap about the axle in the opposite direction from the initial position of the line. The user then applies a force to the line to slow the rotation of the axle and decelerate the flywheel. The user applied force preferably stops the rotation of the flywheel and axle when a portion of the line is wrapped about a portion of the axle. In one embodiment, the line may wrap and unwrap around an axle with a gradually increasing diameter. Preferably, this causes the acceleration of the axle to be continuously changing.

Another aspect of this invention is an exercise apparatus with two axles which are interconnected with a synchronizing assembly such that both axles rotate. One end of a line is attached to the first axle. In an initial position, a portion of the line is wrapped about a portion of the first axle. A flywheel is axially mounted to the second axle. A user applying a force to the unattached end of the line creates an accelerating torque on the axle, causing the axle to begin rotating and the line to begin unwrapping. Due to the synchronizing assembly, the second axle also rotates, which causes the flywheel to rotate. When the line becomes completely unwrapped from the first axle, the inertia of the flywheel causes the second axle to continue rotating in the same direction and, hence, the first axle also continues to rotate in the same direction. Rotation of the first axle causes the line to wrap about the first axle in the opposite direction from the initial position of the line. The user then applies force to the line to slow the rotation of the first axle and, due to the synchronizing assembly, also the second axle, causing the rotational velocity of the flywheel to decrease. The user applied force preferably stops the rotation of the flywheel and axles when a portion of the line is wrapped about a portion of the first axle. In one embodiment, the line wraps and unwraps around an axle with a generally increasing diameter. In another embodiment, a generally constant force applied to the line results in a generally continuously changing acceleration of the axle.

Yet another aspect of this invention provides a rotatably mounted axle and a flywheel mounted to the axle. A linkage connects a grip to the axle. A force applied to the grip in a first direction causes the axle and flywheel to rotate in one direction. A force applied to the grip in a second direction causes the axle and flywheel to slow or stop rotating in that direction. A continued force in the second direction may cause the axle and flywheel to rotate in the opposite direction.

The present invention also relates to a method of creating resistance for exercising which utilizes the rotational inertia of a flywheel. The user exercises his or her muscles by exerting a force which alternately accelerates and decelerates a rotating flywheel. In one aspect of the invention, the user applies a positive work movement to the apparatus to increase the rotational velocity of the flywheel and a negative work movement to the apparatus to decrease the rotational velocity of the flywheel. The positive work movement creates a force which is translated into a torque. That torque is applied to the flywheel in a first direction to accelerate the flywheel. A negative work movement creates a second force which is translated into a second torque. The second torque is applied to the flywheel in a direction opposite the first direction. This causes the flywheel to decelerate.

DESCRIPTION OF THE PREFERRED EMBODIMENTS

Figure 1:
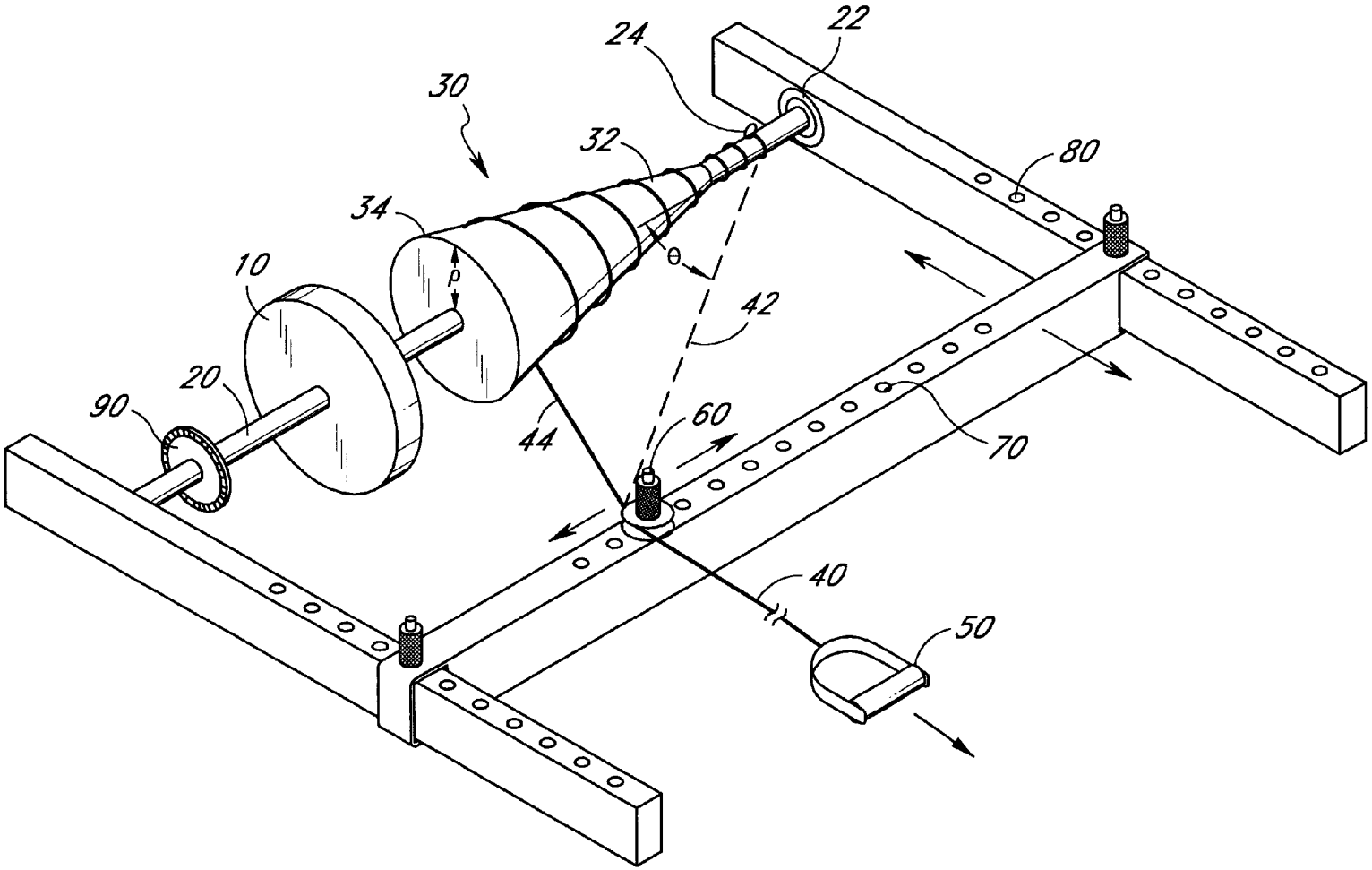
FIG. 1 is a perspective view of a preferred embodiment of an inertial resistance exercise device according to the present invention, illustrating a line attached at one end to a flywheel assembly axle and a spool mechanism.

FIG. 1 illustrates an embodiment of the inertial resistance exercise device according to the present invention. A mass 10, preferably in the form of a flywheel, is mounted on an axle 20. A spool 30 may also be mounted to the axle 20. In an alternative embodiment, the flywheel 10 may be incorporated into the spool 30. As discussed below, the spool 30 may be configured in a number of shapes and sizes depending upon the manner and intensity of exercise desired by the user. The axle 20 is preferably supported by bearings 22. Proximate one end of the axle 20 is an anchor 24. One end of a line 40 is attached to the axle 20 at the anchor 24. The opposite end of the line 40 is attached to a grip 50 or other member which allows a user to apply force to the line 40.

As an alternative to the embodiment illustrated in FIG. 1, the mass of the flywheel 10 can be incorporated into the spool 30, eliminating the need of a separate flywheel and spool. As another alternative embodiment, the spool 30 can be eliminated, so only a flywheel 10 is mounted on the axle.

In a preferred embodiment, the line 40 is supported between its two ends by a pivot 60. The pivot 60 preferably can be located at one of multiple adjustable pivot positions. For instance, the pivot 60 is preferably positioned at one of multiple locations located parallel to the axle 20. Additionally, the pivot 60 is preferably positioned at one of multiple locations perpendicular to the axle 20. One of ordinary skill in the art will appreciate that the pivot 60 may be located at a wide variety of locations and distances from the axle 20. Additionally, the pivot 60 may be movable relative to the axle 20 during exercise or located at a single fixed pivot point. The multiple pivot points allow the difficulty of the exercise to be adjusted, as described below. The pivots 60 preferably comprise pulleys or other similar rotatable members.

The apparatus shown in FIG. 1 allows a user to exercise utilizing a positive work portion followed by a negative work portion to complete one cycle or "repetition" of the exercise. To complete an exercise "set," a user would perform the desired number of such repetitions. The positive work portion of each repetition of the exercise begins with the line 40 in a wrapped position 44. In this position, the line 40 is wrapped around a portion of the axle 20, a portion of the spool 30, or some combination thereof, depending on the position of the pivot 60. In order to exercise, the user applies a force to the grip 50 which, translated through the line 40, creates an accelerating torque on the axle 20. This torque causes the axle 20 to turn and the rotational velocity of the flywheel 10 to increase. As the user pulls the grip 50 in a direction away from the axle 20, typically contracting a muscle or muscle group, the line 40 unwraps from the axle 20. The axle 20 turns in either a clockwise or counterclockwise manner, depending on the direction that the line 40 unwraps from the axle 20. Eventually the unwrapping line reaches its fully unwrapped position, illustrated by broken line 42. The inertia of the flywheel 10 causes the axle 20 to continue rotating in the same direction, and the line 40 will begin to wrap around the axle 20 and/or a portion of the spool 30 in a direction opposite its initial direction. At this point, the negative work portion of the exercise begins.

The negative work portion of the exercise starts with the line 40 in its unwrapped position 42 and with the axle 20 rotating at an angular velocity. As the axle 20 rotates, the line 40 begins to wrap around the axle 20 in the opposite direction of that during the positive work portion of the exercise. As the line wraps around the axle 20 and/or a portion of the spool 30, the line 40 typically pulls the grip 50 towards the axle 20. The user now must apply a resisting force to the grip 50, typically with the user's muscles lengthening under this force. This force, translated through the line 40, creates a decelerating torque on the axle 20, reducing the angular velocity of the axle 20. Eventually, the flywheel 10 ceases rotation, completing one cycle or repetition of the exercise. At the end of each repetition, it will be understood that the line 40 is wrapped around the axle 42 and spool 30 in the opposite direction from the previous repetition.

A user, for example, may exercise the biceps by grasping the handle 50 and pulling the handle 50 towards the body of the user while keeping the elbow in a generally stationary position. This is typically known as an exercise "curl." The elbow is preferably located such that the biceps are fully contracted and the line 40 is completely unwrapped from the axle 20. More preferably, a mark on the device or other structure, such as a padded member, is used to indicate the correct positioning of the elbow. When the inertia of the flywheel 10 and axle 20 causes the line 40 to begin wrapping around the axle 20, the handle 50 is pulled towards the axle 20. The user preferably slows and gradually stops the rotation of the flywheel 10 and axle 20 by using the biceps. Thus, the biceps can be exercised in a positive and negative work portion during one exercise repetition.

In a preferred embodiment, the line 40 shown in FIG. 1 is partially elastic. More preferably the portion of the line 40 which attaches to the axle 20 at the anchor 24 is partially elastic. Most preferably this portion of the line that is elastic is about 4 to 10 inches in length. Alternately, the portion of the line attached to the grip 50 may be elastic or the entire line 40 may be elastic or inelastic. The elastic line 40 allows a smoother transition between the unwinding of the line during the positive work portion of the exercise and the winding of the line during the negative work portion of the exercise. Otherwise, the line 40 may "snap-back" as the axle changes direction.

An encoder 90 or other similar device may be attached to the axle 20. The encoder 90 can be used, for example, to provide an input to an instrumentation device (not shown) for determining information such rotational velocity, rotational acceleration, number of repetitions, and elapsed exercise time. The instrumentation device may include a display which may show the user, for example, the amount of force exerted and calories consumed during the exercise. For example, in the simple case where there is no spool and the line is always perpendicular to the axle, the relationship between rotational acceleration of the axle, α, and the torque, T, applied to the axle is:

$$\tau=I\cdot\alpha \tag{1}$$

where I is the moment of inertia of the flywheel. Also, the relationship between force applied to the grip 50 and torque is:

$$F=\tau/r, \tag{2}$$

where r is the radius of the axle. Combining equations (1) and (2) yields:

$$F=\alpha\cdot I/r. \tag{3}$$

Thus, the force on the line can be computed from the rotational acceleration of the axle sensed by the encoder. The work exerted by the person performing the exercise is:

$$W=F\cdot x, \tag{4}$$

where x is the linear distance over which the force, F, is applied, which can be expressed as:

$$x=2\pi\cdot n\cdot r, \tag{5}$$

where n is the number of axle rotations. Thus, the work expended by the exercise can be expressed as:

$$W=F\cdot 2\pi\cdot n\cdot r \tag{6}$$

or $$W=\alpha\cdot I\cdot 2\pi n, \tag{7}$$

where F is determined from equation (3). Thus, the work expended can be computed from the number of axle rotations and rotational acceleration sensed by the encoder. This expended work may be expressed in units of calories and displayed to the person exercising. For different configurations of the inertial resistance exercise device, similar relations between rotational acceleration, force, number of rotations and calories burned can be expressed, calculated and displayed by an instrumentation device.

The force exerted by the user can be calculated. In this example, the flywheel 10 is a uniform density disk of radius, R. The flywheel's moment of inertia, I, can be expressed as:

$$I=\tfrac{1}{2}M\cdot R^2, \tag{8}$$

where M is the flywheel mass. Rewriting equation (2) and substituting the above expression for I yields the following expression for the rotational acceleration of the flywheel:

$$\alpha=2(F/M)(r/R^2). \tag{9}$$

Further, the rotational displacement of the axle, in radians, can be expressed as:

$$\phi=\tfrac{1}{2}\alpha\cdot t^2. \tag{10}$$

Thus, from equations (5), (9) and (10), the linear displacement of the grip may be expressed as:

$$x=(F/M)(r/R)^2\cdot t^2. \tag{11}$$

Using the above expression and assuming the following parameters for an inertia exercise device:

F=200 newtons (≈45 pounds)

M=10 kilograms (≈22 pounds)

r=0.02 meter (≈¾ inches)

R=0.2 meter (≈8 inches)

t=2 seconds;

yields: x=0.8 meter (≈2½ feet).

Thus, an inertia exercise device utilizing a 10 Kg. (22 lb.) flywheel which has an 0.2 m. (8 in.) radius and is mounted to an axle having a 0.02 m. (¾ in.) radius can accommodate an exercise having a 0.8 m (2½ ft.) range-of-movement over a 2 sec. interval under a constant 45 lb. force applied to the grip.

Referring again to FIG. 1, the inertial resistance exercise device according to the present invention may incorporate multiple pivot locations which can be used to adjust the difficulty of the exercise. The relationship between pivot location and exercise difficulty can be understood by considering the relationship between the force applied to the grip, F, and the resulting torque, τ, applied to the axle. The torque, τ, is equal to the component of force, F, which is exerted perpendicular to the axle, F⊥, times the "moment arm," ρ, of that force. That is:

$$\tau=\perp\cdot\rho, \tag{12}$$

where ρ is equal to the perpendicular distance from the axis of the axle to the point of application of the force component, F⊥, on the axle.

The pivot location determines the amount of grip force, F, which is translated to F⊥. Specifically, the pivot location determines θ, which is the angle between the line 40 and the axle 20. In turn, θ determines both F⊥ and F‖, where F‖ is the component of F which is parallel to the axle. The relationship between these force components and θ is:

$$F\perp=F\cdot\sin\theta \tag{13}$$

$$F\perp=F\cdot\cos\theta \tag{14}$$

$$F^2=F\perp^2+F\|^2. \tag{15}$$

These force relationships are illustrated in FIGS. 2–3.

Figure 2A:
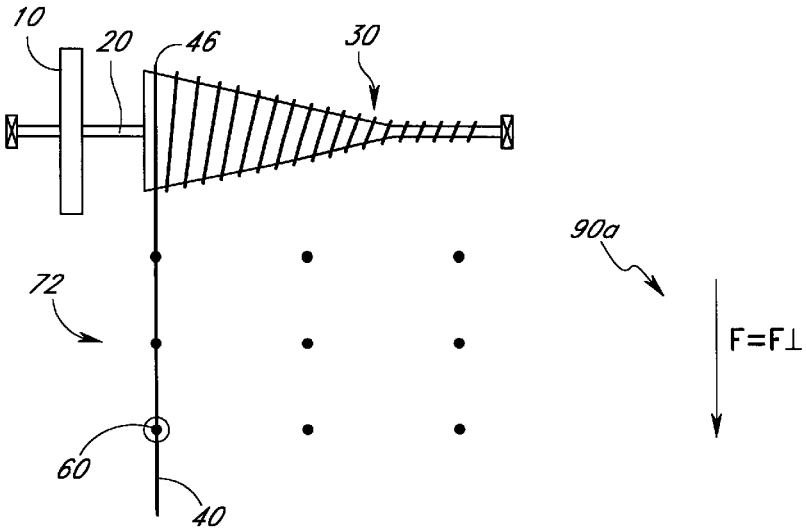
FIGS. 2A–C are schematic representations of the flywheel assembly illustrated in FIG. 1 depicting various line positions for the particular pivot location shown.
Figure 2B:
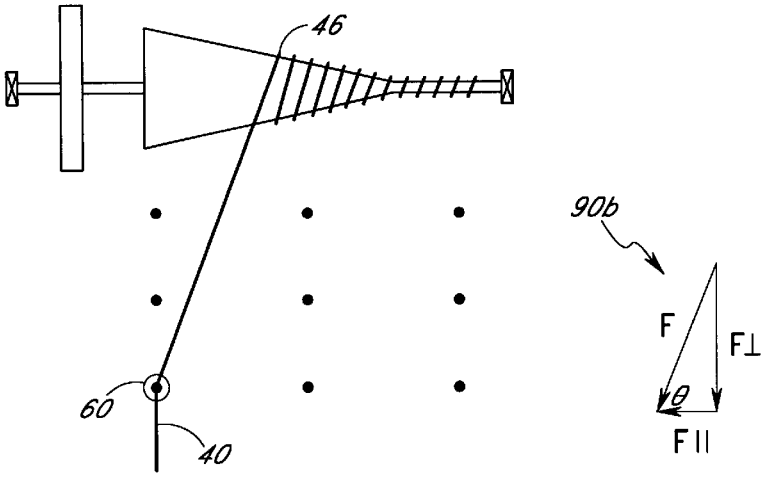
Figure 2C:
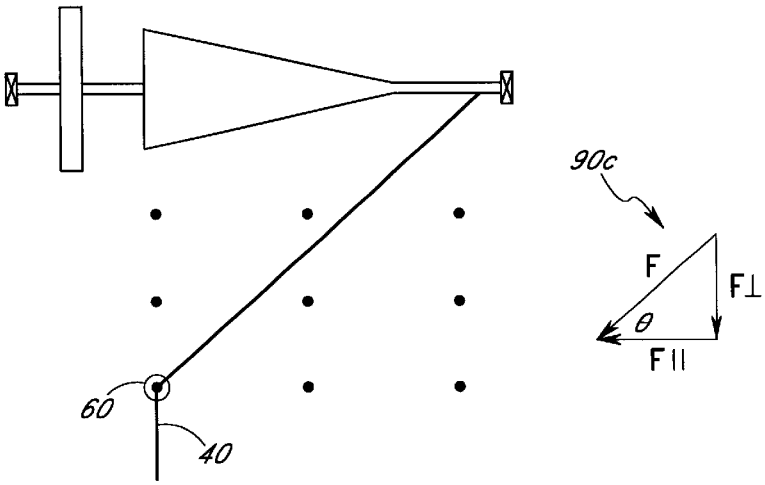
Figure 3A:
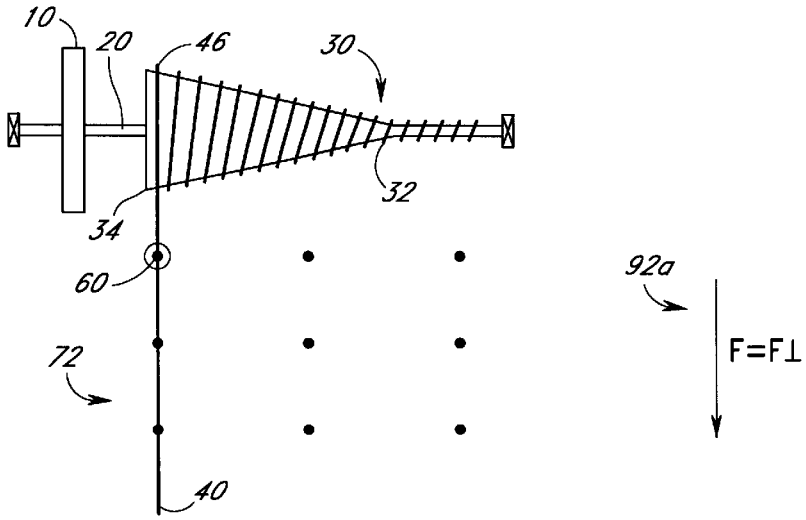
FIGS. 3A–C are schematic representations of the flywheel assembly illustrated in FIG. 1 depicting various line positions for the particular pivot location shown.
Figure 3B:
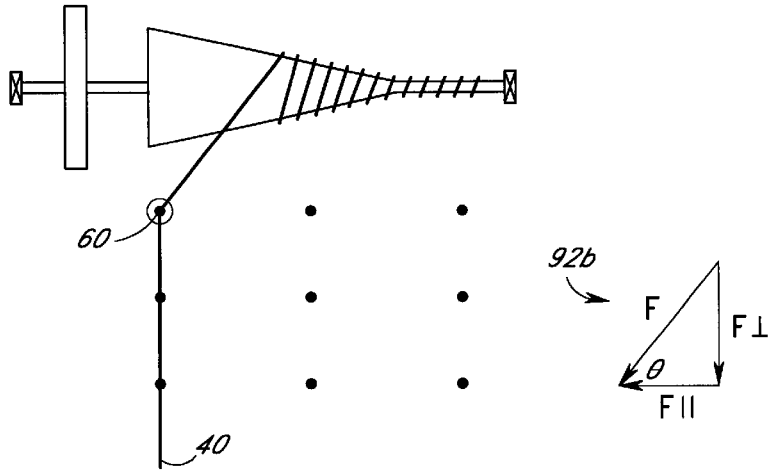
Figure 3C:
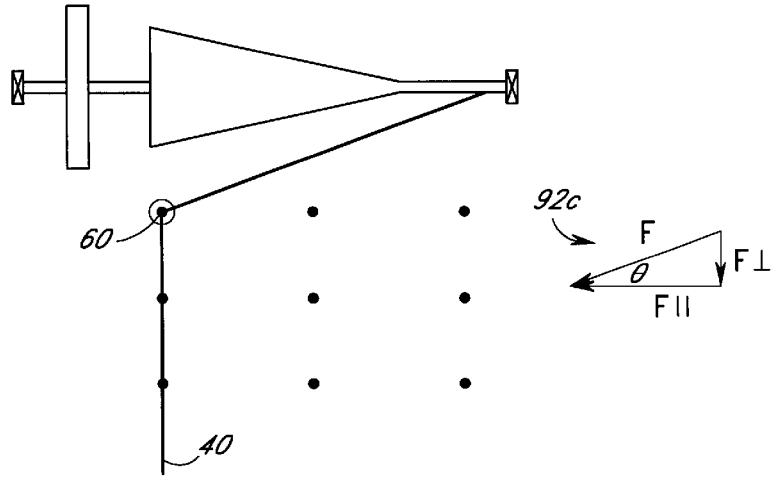

FIGS. 2–3 are schematic representations of the flywheel 10, axle 20, spool 30 and line 40. Also depicted in FIGS. 2 and 3 are vector force diagrams 90, 92 illustrating the grip force, F; its components perpendicular and parallel to the axle, F⊥ and F‖, respectively; and the angle θ between the line 40 and the axle 20. A comparison of FIGS. 2 and 3 illustrates the effect of pivot location on exercise difficulty. The angle θ between the line 40 and the axle 20 varies as the distance and position of the pivot 60 is adjusted relative to the axle 20. In FIGS. 2A–C, the pivot 60 is located a greater distance from the axle 20 than in FIGS. 3A–C. For example, in FIG. 2B θ is greater than for the similar line position shown in FIG. 3B. Similarly, in FIG. 2C θ is greater than for the similar line position shown in FIG. 3C. The impact of pivot location on exercise difficulty is apparent from a comparison of the vector diagrams 90A–C and 92A–C of FIGS. 2–3. The perpendicular component of line force, F||, contributes to axle torque, i.e., the force rotating the flywheel 10. Therefore, because the component of line force perpendicular to the axle 20 is greater in FIGS. 2B–C than in FIGS. 3B–C, the pivot location shown in FIG. 2 results in a relatively easier exercise to the user because less force must be exerted on the grip to create the same rotational force. In other words, moving the pivot 60 closer to the axle 20, as in FIGS. 3A–C, decreases θ and reduces the torque for a given line force, making the exercise relatively harder. Similarly, moving the pivot farther from the axle, as in FIGS. 2A–C, increases θ and increases torque for a given line force, making the exercise relatively easier. Further, θ affects the snap-back which may occur when the axle changes direction. The smaller the angle θ, the smoother the transition between the positive and negative portions of the exercise.

The pivot location also determines the moment arm, ρ, of F|| because the pivot location determines the position of the line on the spool. The spool 30 preferably has a radius that is a function of distance along the length of the spool 30. More preferably, the spool 30 is conical in shape with a constantly increasing radius. Alternatively, it will be understood the spool 30 may comprise a variety of shapes and sizes depending upon the desired exercise resistance of the user. The moment arm, ρ, is equal to the spool radius at the point of contact between the line and the spool. This relationship between pivot location and ρ is illustrated in FIGS. 3–4.

In FIG. 3A, the pivot 60 is located proximate the wide end 34 of the spool 30. In this position, the first line wrap 46 is coiled around this wide end 34 at the beginning and end of an exercise cycle. By comparison, in FIG. 4A, the pivot 60 is located proximate a middle portion 33 of the spool 30, between the wide end 34 and the narrow end 32. It follows that the torque, τ, for a given line force, F, is greater in FIG. 3A than in FIG. 4A because the moment arm, ρ, at the wide end 34 of the spool 30 is greater than at a middle portion 33 of the spool 30. Thus, it is easier to start and end the rotation of the axle 20 in FIG. 3A than in FIG. 4A. By comparing FIG. 3B with FIG. 4B and FIG. 3C with FIG. 4C, it is also clear that this mechanical advantage of a greater moment arm is present throughout the exercise cycle for the pivot location in FIG. 3 as compared with FIG. 4. Hence, the exercise is relatively easier as the pivot 60 is located closer to the wide end 34 of the spool and relatively harder as the pivot is located closer to the narrow end 32 of the spool.

Referring again to FIG. 1, the spool 30 affects the force-speed exercise profile. That is, the spool shape determines the relationship between force applied to the grip 50 and the linear velocity of the grip 50. With free-weights, an exercise can be performed with a constant applied force at any speed-of-movement. For example, free-weights allow a constant force and constant speed exercise profile. By comparison, without a spool, a constant pull force applied to the grip 50 would result in an acceleration of the axle and an increasing speed-of-movement. To maintain a constant speed-of-movement, for instance, a decreasing applied force would be necessary throughout the positive movement portion of the exercise cycle.

Figure 4A:
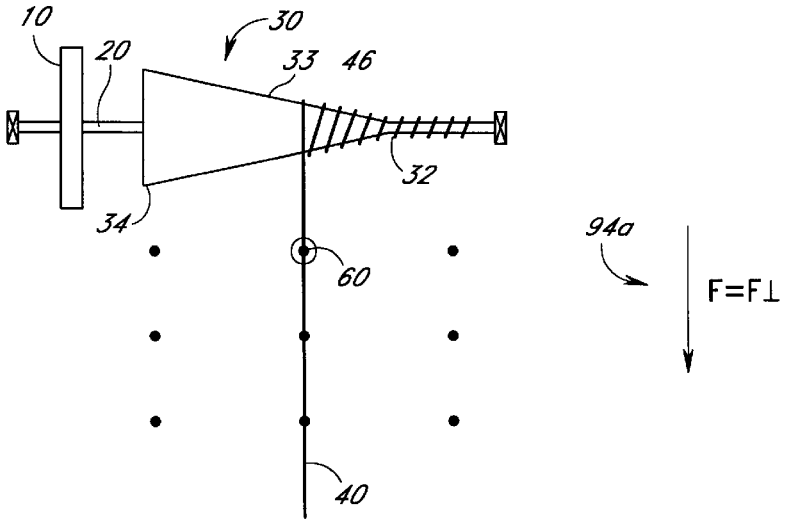
FIGS. 4A–C are schematic representations of the flywheel assembly illustrated in FIG. 1 depicting various line positions for the particular pivot location shown.
Figure 4B:
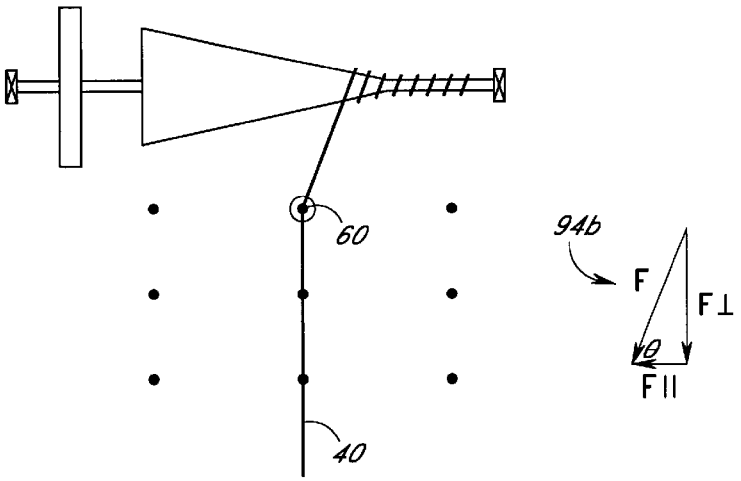
Figure 4C:
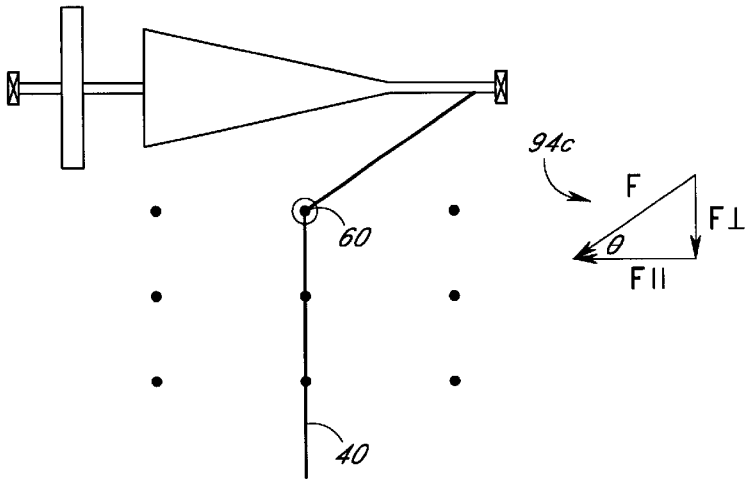
Figure 4D:
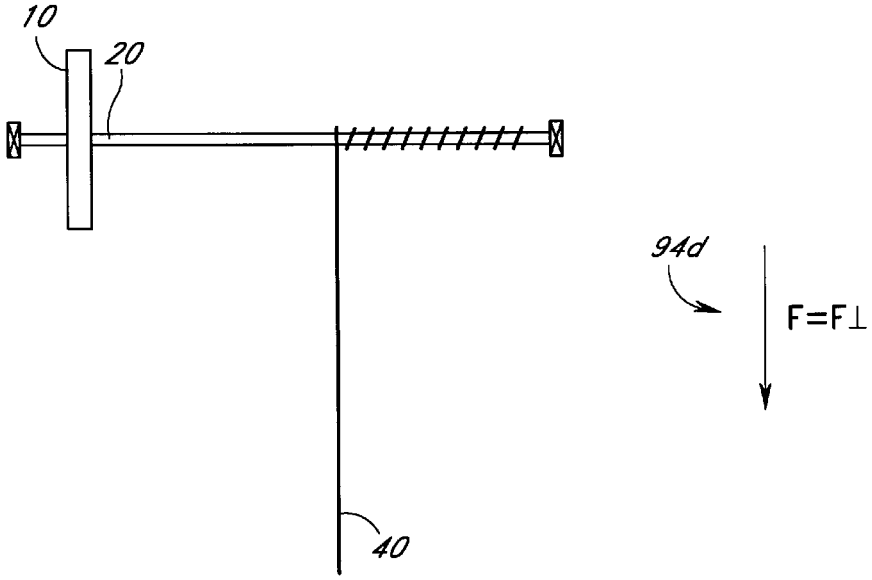
FIG. 4D is a schematic representation of the flywheel assembly illustrated in FIG. 1 without the spool mechanism.

For example, in the simple case where there is no spool and the line force, F, is always applied perpendicular to the axle, as shown in FIG. 4D, the relationship between the work applied by the user and the resulting kinetic energy created in the flywheel is:

$$F\cdot x=\tfrac{1}{2}I\cdot\omega^2, \tag{16}$$

where x is the linear distance over which the force, F, is applied; I is the flywheel's moment of inertia; and ω is the angular velocity of the flywheel. The relationship between the linear velocity, v, of the exercise movement and the angular velocity of the flywheel is:

$$v=\omega\cdot r; \tag{17}$$

where r is the radius of the axle around which the line 40 is wrapped, assuming a tightly wrapped coil. Thus:

$$F\cdot x=\tfrac{1}{2}\cdot I\cdot(v/r)^2 \tag{18}$$

or $$(dx/dt)^2-2(F\cdot r^2/I)\cdot x=0. \tag{19}$$

Solving (19) for x yields:

$$x=\tfrac{1}{2}\cdot(F\cdot r^2/I)\cdot t^2, \tag{20}$$

where t is the time duration of the exercise. It is therefore apparent from equation (20) that, without a spool, for a constant applied force, is, the speed-of-movement is proportional to the square of the duration that the force is applied. That is, there is not a constant force and constant speed exercise profile without a spool.

In a preferred configuration, a spool 30 with a generally conical shape is utilized to achieve a force and speed-of-movement exercise profile which provides a generally constant force and generally constant speed of movement exercise profile. Referring again to FIG. 1, at the beginning of an exercise cycle, with the line 40 in its wrapped position 44, the line 40 extends away from the axle near the wide end 34 of the conical spool 30. Thus, a relatively small force on the grip S0 is required to accelerate the axle 20, and a relatively large amount of line 40 unwraps from the spool 30 per revolution of the axle 20. This compensates for the relatively small initial rotational velocity of the axle 20. By the time the line 40 is near its unwrapped position 42, the line extends away from the axle 20 near the narrow end 32 of the conical spool 30. In this position, a relatively large amount of force on the grip 50 is required to accelerate the axle 20, and a relatively small amount of line 40 is being unwrapped from the axle 20 per revolution. This, however, compensates for the relatively large rotational velocity of the axle 20 at this portion of the exercise cycle. The spool also has the effect of allowing the line to unwrap to a small diameter, reducing the snap-back when the axle reverses directions. One of ordinary skill in the art will recognize that other spool shapes will result in a variety of force-speed exercise profiles.

The spool 30 illustrated in FIG. 1 may be a variety of shapes and may extend the entire length of the axle or only a portion of the axle. In a preferred embodiment shown in FIG. 1, the spool 30 is conical in shape, with a narrow end 32 near the anchor 24 and a wide end 34 which is farther from the anchor 24. Preferably the anchor 24 is configured immediately adjacent the spool narrow end 32 such that the line 40 can wrap almost the entire length of the spool 30.

Figure 5:
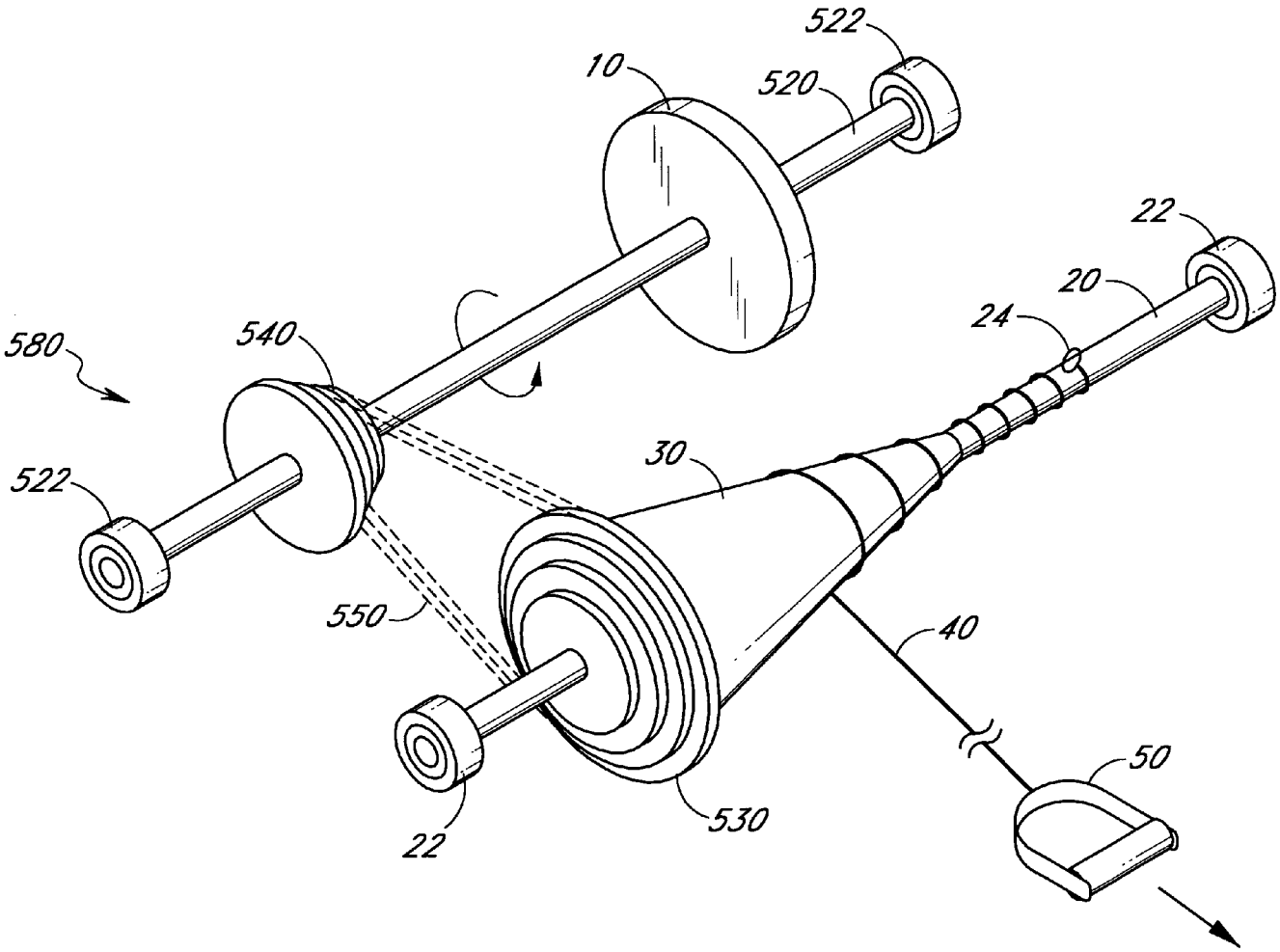
FIG. 5 is a perspective view of another preferred embodiment of the inertial resistance exercise device illustrating dual axles and a spool mechanism.

FIG. 5 illustrates another embodiment of a flywheel assembly for an inertial resistance exercise device according to the present invention. As in the embodiment illustrated in FIG. 1, this embodiment has a spool 30 mounted on a first axle 20 which is supported by bearings 22. Also, as in FIG. 1, this embodiment has a line 40 which is attached to the axle 20 at one end by an anchor 24. Unlike the embodiment of FIG. 1, however, the embodiment illustrated in FIG. 5 has a flywheel 10 mounted on a second axle 520 which is supported by a second set of bearings 522. The two axles 20, 520 are interconnected with a synchronizing assembly 580 such that rotation of one axle causes the other axle to rotate.

In one embodiment of the synchronizing assembly 580, a first sprocket 530 is mounted on the first axle 20. A second sprocket 540 is mounted on the second axle 520. The first sprocket 530 and second sprocket 540 are interconnected by a substantially inelastic line 550. If the first sprocket 530 has a larger diameter than the second sprocket 540, this configuration causes the second axle 520 to rotate faster than the first axle 20. Thus, for the same flywheel 10 mass (as shown in FIG. 1), a higher force is required for the configuration of FIG. 5 than the configuration of FIG. 1. For example, if the first sprocket 530 is four times larger in diameter than the second sprocket 540, a given pull force on the line 40 causes the second axle 520 to rotate four times faster than the first axle 20. Thus, the work required for a given rate of pull is sixteen times higher than if the flywheel 10 were mounted on the first axle 20. Alternatively, the first sprocket 530 may have a smaller or equal diameter to the second sprocket 540.

It will be understood that multiple sprockets of various diameters may be mounted on each axle such that various relative axle speeds may be achieved merely by relocating the line 550. One skilled in the art will understand the line 550 may comprise a chain, cog belt, or pulley belt or the like to interconnect the appropriate pair of sprockets. The two axles shown in FIG. 5 may also be interconnected with a line which wraps onto one axle as it wraps off the other axle. This axle connecting line could be used as the synchronization assembly or in conjunction with a separate synchronization assembly.

Figure 6:
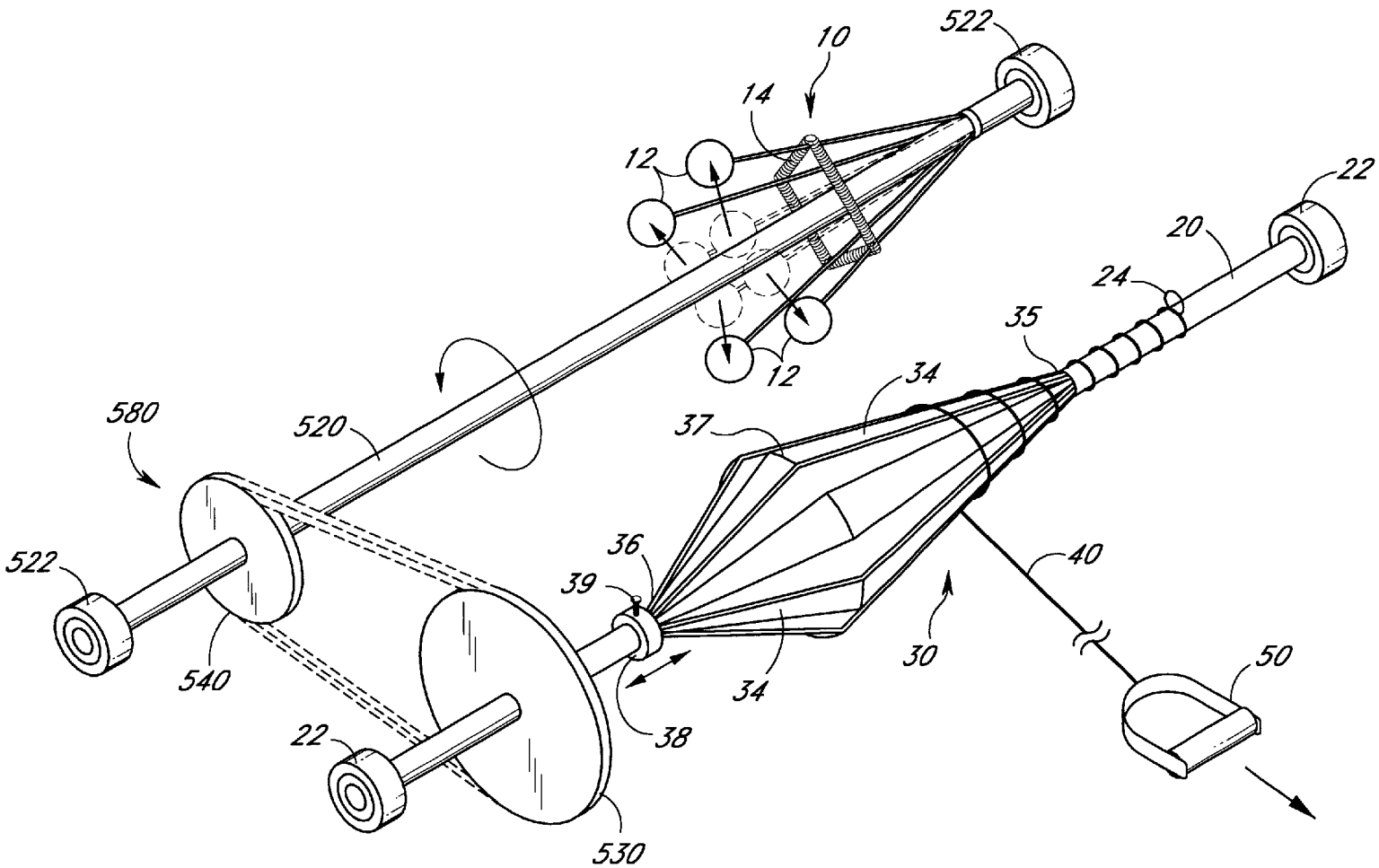
FIG. 6 is a perspective view of yet another preferred embodiment of the inertial resistance exercise device illustrating a variable-slope conical spool mechanism and a governor-like flywheel mechanism.

FIG. 6 illustrates yet another embodiment of a flywheel assembly for an inertial resistance exercise device according to the present invention. As in the embodiment illustrated in FIGS. 1 and 5, this embodiment has a spool 30 mounted on a first axle 20 which is supported by bearings 22. Also as in FIGS. 1 and 5, this embodiment has a line 40 which is attached to the axle 20 at one end by an anchor 24. Unlike these other embodiments, however, the embodiment illustrated in FIG. 6 has a flywheel 10 in the form of spring-loaded weights. That is, the flywheel 10 has weights 12 attached to the axle 520 or another portion of the flywheel with one or more springs 14. These spring-loaded weights 12 move away from the axle 520 with faster rotational velocities of the axle 520. For example, in an initial position (shown in phantom), the weights 12 are positioned generally proximate to the axle 520. As the axle 520 rotates, the weights 12 move away from the axle 520 as shown. As the weights 12 move away from the axle 520, this increases the moment of inertia of the flywheel 10, increasing the force which must be applied to the grip 50 to continue to accelerate the flywheel 10 as its rotational velocity increases. Thus, a spring-loaded flywheel 10 creates a governor-like flywheel mechanism and can be used to modify the force-speed exercise profile.

FIG. 6 also illustrates an alternative embodiment of the spool 30 in which the spool 30 is constructed to have a variable-slope surface. Varying the spool slope alters the force-speed exercise profile as discussed above. To allow varying of the spool slope, the spool 30 may be composed of rods or sections 34 having swivel points 35, 36 at the spool ends and the rods 34 are connected at hinge points 37. Preferably, the swivel points 36 at one end of the spool 30 are connected to a slidable sleeve 38 mounted to the axle 20. The sleeve 38 can be moved along the axle 20 in one direction to cause the rods or sections 34 to swivel away from the axle 20, increasing the spool slope and in the opposite direction to cause the rods or sections 34 to swivel toward the axle 20, decreasing the spool slope.

It will be understood that the rods or sections 34 and sleeve 38 may be used in conjunction with weights 12 to vary the distance of the weights 12 from the axle 520. Such an arrangement may be used with or without springs to modify the inertia of the flywheel 10.

Figure 7:
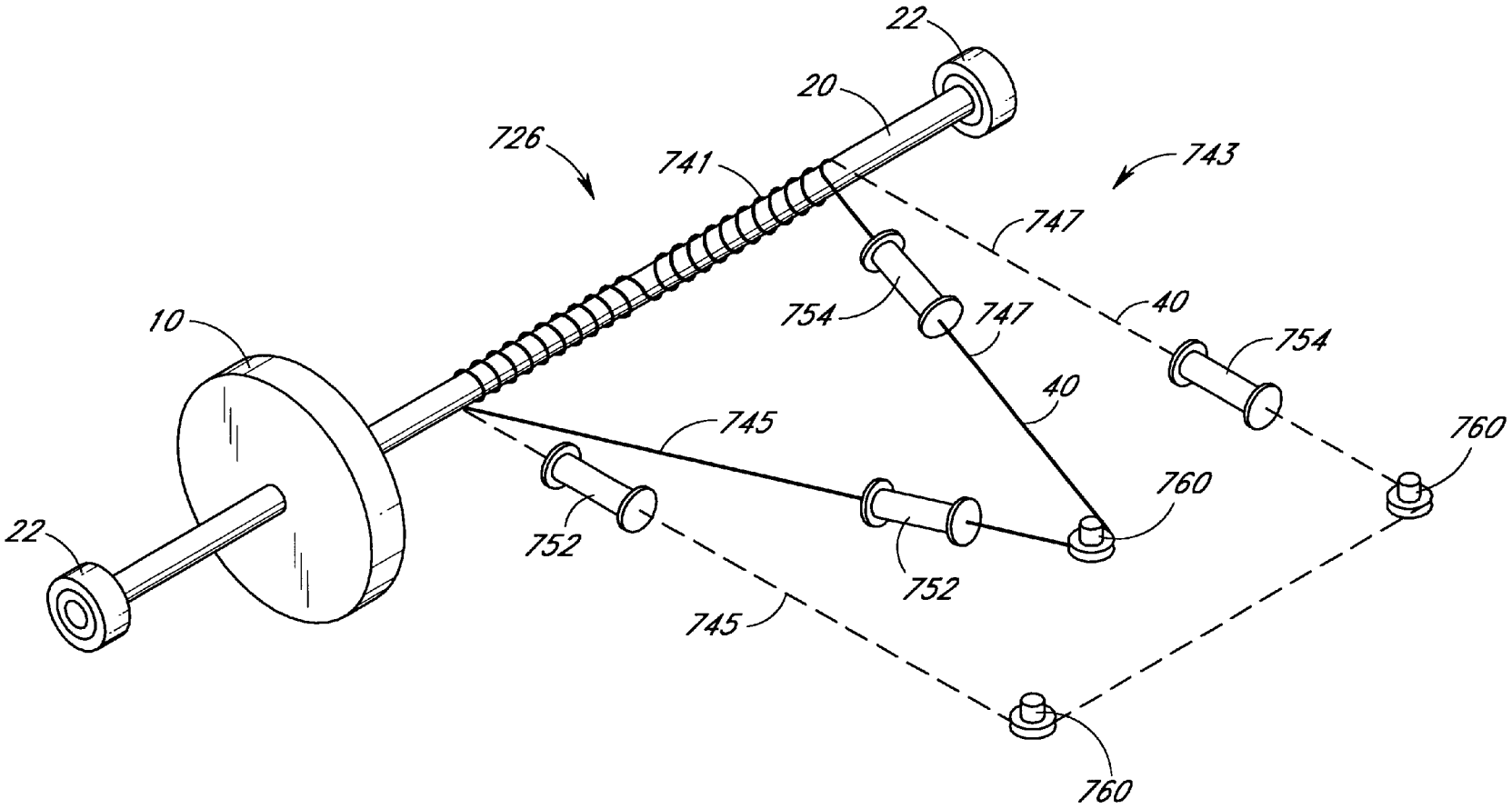
FIG. 7 is a perspective view of still another preferred embodiment of the inertial resistance exercise device illustrating a line with both ends attached to a flywheel assembly axle.

FIG. 7 illustrates yet another embodiment of the inertial resistance exercise device according to the present invention. As in the embodiments illustrated in FIGS. 1 and 5, this embodiment has a flywheel 10 mounted on an axle 20 supported by bearings 22. In the embodiment of FIG. 7, both ends of the line 40 are attached to the axle 20. In one embodiment, the ends of the line 40 are attached proximate the center 726 of the axle 20. A wrapped portion 741 of the line 40 is formed by coiling the line 40 about the axle 20 on either side of the axle center 726. As another alternative, the ends of the line 40 may be attached at separate points on either side of the axle center 726, with the wrapped portion 741 being formed by coiling the line 40 about the axle 20 and toward the axle center 726. As yet another alternative, the ends of the line 40 are attached together to form a continuous loop, which is also wrapped about the axle 20. A center portion 743 of the line 40 extends away from the axle 20 and is supported by a single pivot 760. Alternatively, the center portion 743 may be supported by a plurality of pivots 760 similarly located (as shown, for example, in phantom).

The inertial resistance exercise devices illustrated in FIGS. 1, 5 and 6 involve the same muscle group performing both positive and negative work. The positive work portion of the exercise oscillates with the negative work portion of the exercise each time the rotation of the axle changes direction. In contrast, the inertial resistance exercise device illustrated in FIG. 7 provides an exercise in which one muscle group performs a positive work portion and an antagonist muscle group performs a negative work portion for each direction of axle rotation. The positive and negative movements of the exercise oscillate between muscle groups each time the rotation of the axle changes directions.

Referring to FIG. 7, a grip 752 may be attached to one side 745 of the line center portion 743. Another grip 754 may be attached to the side 747 of the line center portion 743 on the opposite side of the pivot or pivots 760. A force applied to one grip or both grips 752, 754 in opposite directions causes the axle to rotate in one direction. As the axle rotates, the total amount of line 40 coiled about the axle generally does not increase or decrease because the line 40 wrapped around one side of the axle is unwrapped at the same speed as the line 40 is wrapped around the other side of the axle.

When the user applies force to one or both grips 752, 754, the rotational velocity of the flywheel 10 increases and the user performs positive work. At any point, the user can cease applying force to the grips 752, 754 in one direction and apply a force to the one or both grips 752, 754 in the another direction. This causes the rotational velocity of the flywheel 10 to decrease, allowing the user to perform negative work. This negative work portion of the exercise continues until the flywheel 10 stops and the axle 20 begins to rotate in the opposite direction, once again starting a positive work portion. Thus, a full cycle or repetition of this exercise involves, for example, positive work applied to the first grip 752; negative work applied to the opposite grip 754; positive work applied to the opposite grip 754; and, finally, negative work applied to the first grip 752. A similar exercise repetition could be described involving force applied to both grips 752, 754 in opposite directions.

Referring to FIG. 7, many variations of this embodiment are possible. No pivots need be used, but one or more pivots may be used. The variations of the flywheel described with respect to the other aspects of the invention may be incorporated into the flywheel 10 mounted on the axle 20. The flywheel 10 can also be mounted to the axle 20 with a one-way clutch. In that manner, the flywheel inertia is only applied to the axle when the axle 20 rotates in one direction. Similarly, multiple flywheels 10 may be mounted to the axle 20, either with no clutch or with one-way clutches which engage in one of either rotational direction.

It will be understood that the present invention can be utilized in many different configurations. For example, in an embodiment not shown in the accompanying figures, a first flywheel having a primary mass can be directly mounted to the axle along with a second flywheel having a smaller secondary mass mounted with a one-way clutch. With that configuration, the primary mass acts on the axle in either rotational direction, but the secondary mass only acts on the axle in one rotational direction. Thus, the exercise difficulty can be made to vary depending on the particular phase of the exercise cycle. Further, one or two spools of the type described herein with respect to other aspects of the invention may be incorporated into the embodiment shown in FIG. 7 so that the coiled portion 741 of the line on either side of the axle center 726 wraps onto a spool, varying the force-speed exercise profile as described above.

Figure 8:
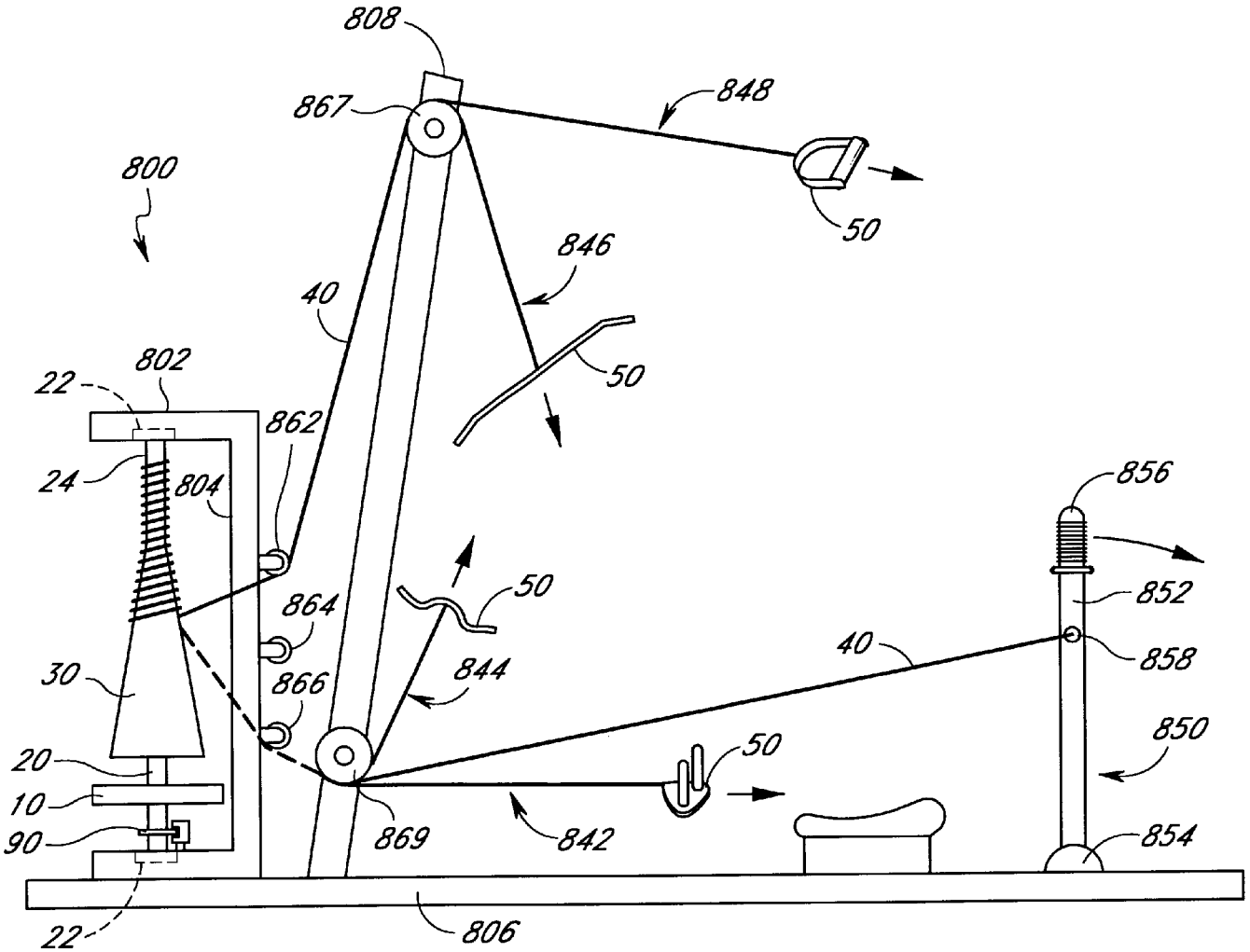
FIG. 8 is an illustration of the inertial resistance exercise device incorporating the flywheel assembly shown in FIG. 1 and illustrating potential configurations and grips to accommodate a variety of exercises.

FIG. 8 illustrates an inertial resistance exercise device 800 according to the present invention, utilizing the flywheel mechanism described above with respect to FIG. 1. A frame 802 containing bearings 22 is mounted to a base 806. The axle 20 is located vertically within the frame 802 and mounted to the bearings 22. Of course, the axle 20 could be located in a horizontal position or any other desired orientation. Mounted on the axle 20 is a flywheel 10 and a spool 30. Multiple primary pivots 862–866 are located at multiple locations along a vertical member 804 of the frame 802. Alternatively, a single fixed or movable pivot may also be utilized. A post 808 is mounted in proximity to the frame 802. The post 808 supports multiple secondary pivots 867, 869 or a single fixed or movable secondary pivot (not shown). One end of a line 40 is attached to the axle 20 at an anchor 24. The other end of the line 40 is attached to a grip 50. The line 40 is preferably supported by one of the primary pivots 862–866 and one of the secondary pivots 867, 869. For the embodiment shown in FIG. 8, the most difficult exercise for the user occurs when the upper primary pivot 862 is used. For the easiest exercise, the lower primary pivot 866 is used. For moderate exercise, the central primary pivot 864 is used.

Depending on the secondary pivot used, a variety of exercises can be performed. If the upper secondary pivot 867 is used, the grip 50 can be held so that the line 40 is in a generally horizontal position 848 and pulled in a generally horizontal direction. For example, with the inertial resistance exercise device configured in this manner, an individual standing sideways to this exercise device could pull the grip 50 in a cross-chest movement to exercise the posterior deltoid. If, with the same configuration, the grip 50 is held so that the line 40 is in a generally vertical position 846, an individual standing facing the exercise device can pull the grip 50 downward to exercise the triceps.

If the lower secondary pivot 869 is used, the grip 50 can be held so that the line 40 is in a generally horizontal position 842 and pulled in a generally horizontal direction. For example, with the inertial resistance exercise device configured in this manner, an individual seated facing the exercise device can perform a seated row exercise to exercise the latissimus dorsi by pulling the grip 50 towards their body. In the same configuration, the grip 50 can be held so that the line 40 is in a generally vertical position 844 and pulled in a generally vertical direction. For example, a individual seated facing the exercise machine can perform an upright row to exercise the trapezius by pulling the grip 50 upwards next to their body.

One of ordinary skill will appreciate many variations of the inertial resistance exercise device illustrated in FIG. 8. The dual-axle flywheel mechanism illustrated in FIG. 5 can be utilized in place of the single-axle flywheel mechanism illustrated in FIG. 1. Further, any of the variations of those mechanisms described above can be incorporated in the exercise machine of FIG. 8. Many other variations are also possible. Additionally, the grip 50 can take many different forms, such as a single handle, two connected handles, various shaped bars for gripping by one or two hands, and various straps or ropes, to name a few.

The line 40 may also be attached to a floor-mounted grip device 850 to create an additional variety of exercise options. For example, a bar 852 may be hinged at one end and have a grip 856 at the opposite end. The line 40 is attached to the bar at point 858. In this manner, pulling the bar 852 creates a pulling force on the line. This basic mechanism can be modified so that a variety of grip positions are available. Further, the bar 852 can be replaced with two bars configured for a rowing movement.

In a preferred embodiment, the flywheel 10 illustrated in FIG. 8 is a disk shaped to have greater mass on or near its outer diameter. Most preferably, a diameter of the flywheel has a generally "dog-bone" shaped cross-section. The preferred flywheel has a radius in the range of 2 to 15 inches and a weight in the range of 2 to 30 pounds. In a more preferred embodiment, the flywheel 10 of FIG. 8 has a radius in the range of 6 to 8 inches and a weight in the range of 10 to 12 pounds.

In a preferred embodiment, the spool 30 illustrated in FIG. 8 has a base radius in the range of ½ to 1½ inches and a length in the range of 4 to 24 inches. In a more preferred embodiment, the spool 30 of FIG. 8 has a base radius in the range of ¾ to 1 inches and a length in the range of 8 to 12 inches.

Figure 9:
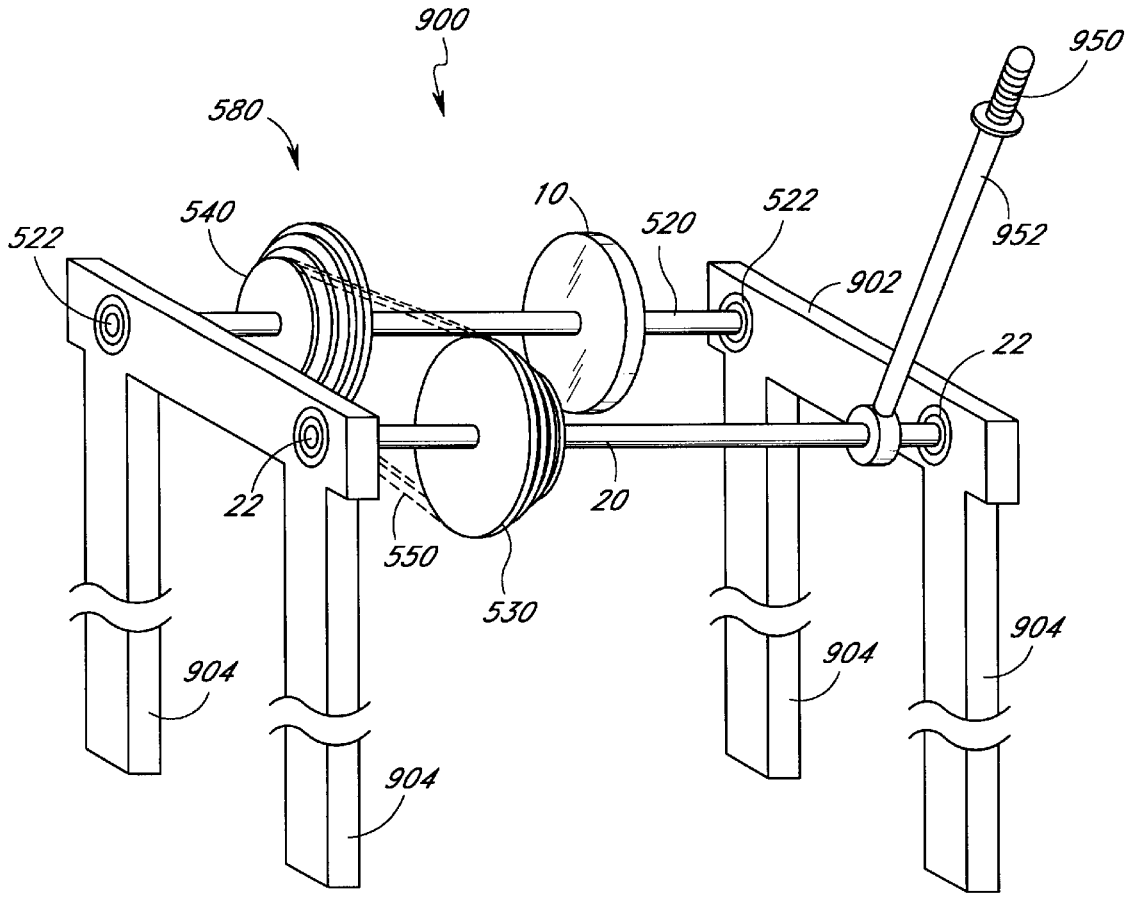
FIG. 9 is a perspective view of the inertial resistance exercise device incorporating the dual-axle flywheel assembly of FIG. 5 without a spool and illustrating an arm exercise configuration.

FIG. 9 illustrates an inertia exercise device 900 according to the present invention, utilizing the flywheel mechanisms and variations described above with respect to other aspects of the invention to create a variety of inertia exercises. The exercise device 900 includes a frame 902 and legs 904 which support the exercise machine 900 on a generally flat surface such as a floor. The frame 902 includes two sets of bearings 22, 522. A first axle 20 is preferably rotatably mounted within bearings 22. A second axle 520 is preferably rotatably mounted within bearings 522. A flywheel 10 is mounted onto the second axle 520 and a linkage 952 is connected to the first axle 20. The linkage 952 is preferably a rigid bar with one end fixed to the axle 20 and a grip 950 attached to the other end. The rigid bar, in contrast to a line, allows the user to apply both a pulling and pushing force to the axle 20. Alternatively, a one way clutch may be used to connect the member 952 to the axle 20 so that the user can apply force to the axle 20 in only one direction. A synchronizing assembly 580 having a first sprocket 530 mounted on the first axle 20 and a second sprocket 540 mounted on the second axle 520 connects the two axles via a substantially inelastic line such as a chain 550.

In operation, a user exercises by applying an alternating pushing and pulling force to the handle 950. This creates an exercise having positive work and negative work portions involving antagonistic muscle groups for each direction of axle rotation, similar to that described with respect to the flywheel mechanism of FIG. 7. That is, a pulling force applied to the grip 950 causes the axle 20 to rotate in one direction. Hence, the synchronizing assembly 580 causes the second axle 520 to rotate. During this phase of the exercise, the rotational velocity of the flywheel 10 increases, resisting the pulling force. One muscle or muscle group of the user, e.g., biceps, contracts under this load, performing positive work. At any point, the user can cease applying a pulling force to the grip 950 and instead apply a pushing force to the grip 950, resisting the rotation of the first axle 20. The rotation of the second axle 520 also slows, due to the synchronizing assembly 580. This causes the flywheel 10 to decrease its rotational velocity, resisting the pushing force. During this phase of the exercise, a different muscle or muscle group, e.g., triceps, are elongating under load, performing negative work. This negative work portion of the exercise continues until the flywheel 10 stops and the axle 20 begins to rotate in the opposite direction, once again starting a positive work portion.

A full cycle or repetition of an exercise utilizing the inertia device of FIG. 9, thus, involves a positive work pulling force of a muscle group applied to the grip 950; a negative work pushing force of an antagonist muscle group applied to the grip 950; a positive work pushing force of a muscle group applied to the grip 950; and, finally, a negative work pulling force of the antagonist muscle group applied to the grip 950. The synchronizing assembly 580 advantageously incorporates multiple sprockets of various sizes mounted on each axle such that various relative axle speeds may be achieved as described above with respect to FIG. 5. This allows the difficulty of the described exercise to be easily varied to suit different users or varying strength of a single user. One of ordinary skill in the art will recognize that the flywheel, grip and synchronizing assembly variations described in connection with FIGS. 1–8 above can be incorporated into the inertia exercise device of FIG. 9.

One of ordinary skill will also recognize many variations with respect to the arrangement of FIG. 9. For example, the linkage 952 may be connected to either sprockets 530, 540 or fly wheel 10 so that torque is applied directly to the sprockets 530, 540 or fly wheel 10, and not the axle 20. Moreover, the linkage may comprise a flexible rod, partially elastic connector, curved member, etc., depending upon the desired exercise to be performed.

In a preferred embodiment, the flywheel 10 illustrated in FIG. 9 is a disk shaped to have greater mass on or near its outer diameter. Most preferably, a diameter of the flywheel has a generally "dog-bone" shaped cross-section. The preferred flywheel has a radius in the range of 2 to 15 inches and a weight in the range of 2 to 30 pounds. In a most preferred embodiment, the flywheel 10 of FIG. 9 has a radius in the range of 6 to 8 inches and a weight in the range of 10 to 12 pounds.

In a preferred embodiment, the synchronizing assembly 580 illustrated in FIG. 9 consists of sprockets having diameters in the range of 2 to 10 inches and having diameter ratios between the two axles ranging from 2 to 10.

Figure 10:
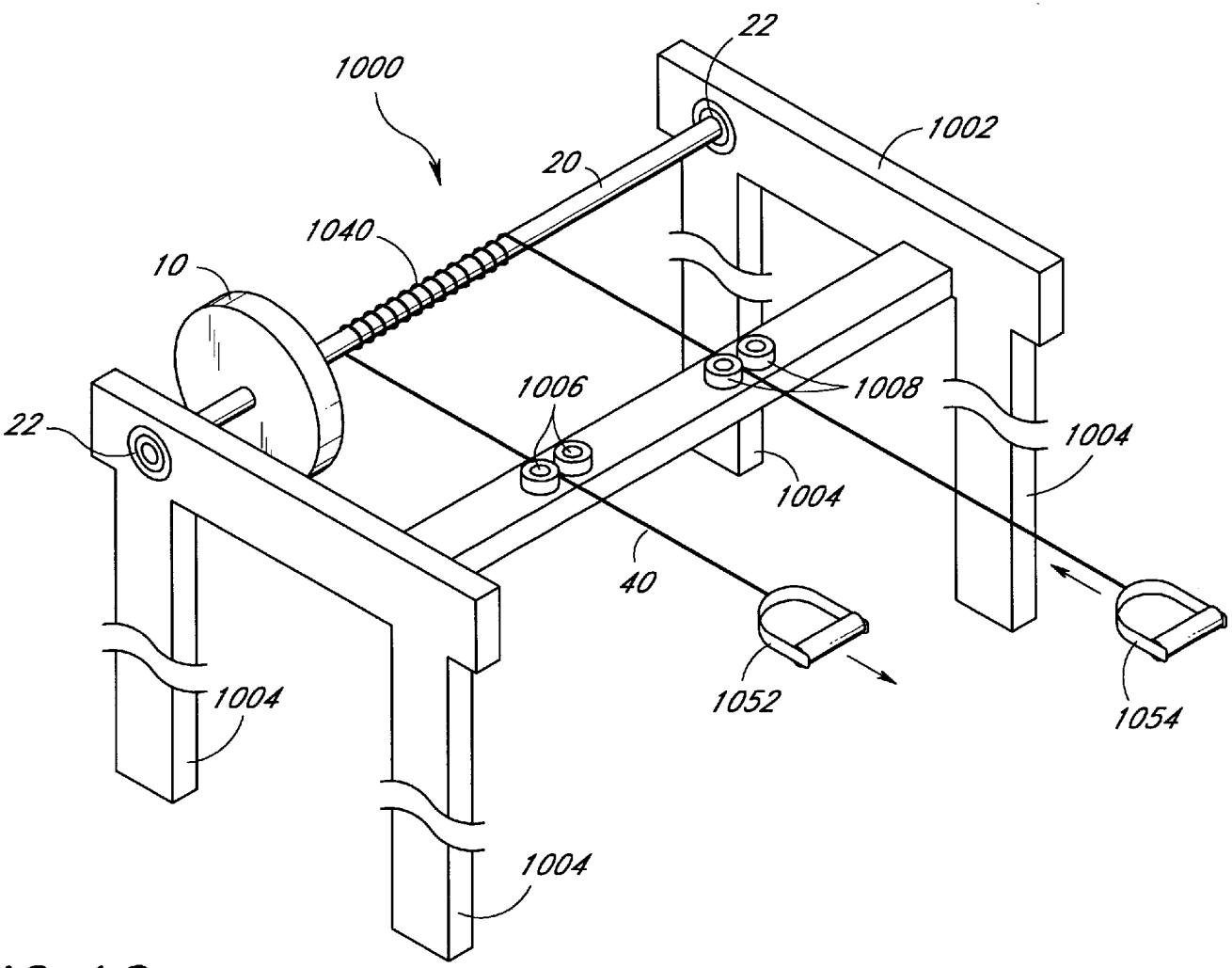
FIG. 10 is a perspective view of an inertial resistance exercise device incorporating the flywheel assembly illustrated in FIG. 7 and illustrating an arm exercise configuration.

FIG. 10 illustrates an example of an inertia exercise device 1000 utilizing a flywheel mechanism similar to that of FIG. 7. The exercise device 1000 includes a frame 1002 and legs 1004 which support the exercise machine 1000 on a generally flat surface such as a floor. The frame 1002 includes bearings 22 within which an axle 20 is preferably rotatably mounted. A flywheel 10 is mounted onto the axle 20 and a line 40 is wrapped around the axle 20 creating a coiled portion 1040 and left and right end portions extending away from the axle. The left and right end portions of the line 40 are disposed between left and right pinch rollers 1006 and 1008 to maintain tension in the line. Left and right grips 1052 and 1054 are attached at the ends of the left and right end portions, respectively.

In operation, a user exercises by applying alternating pulling forces to the left and right grips 1052, 1054. This creates an exercise having oscillating positive work and negative work portions on opposite limbs. That is, a pulling force applied, for example, to the left grip 1052 causes the axle 20 to rotate in one direction. During this phase of the exercise, the rotational velocity of the flywheel 10 increases, resisting the pulling force. The muscles in the user's left arm contract under this load, performing positive work. At any point, the user can cease applying a pulling force to the left grip 1052 and instead apply a pulling force to the right grip 1054, resisting the rotation of the axle 20. This causes the flywheel 10 to decrease its rotational velocity, resisting the pulling force on the right grip 1054. During this phase of the exercise, the muscles in the right arm are elongating under load, performing negative work. This negative work portion of the exercise continues until the flywheel 10 stops and the axle 20 begins to rotate in the opposite direction, once again starting a positive work portion. A full cycle or repetition of an exercise utilizing the inertia device of FIG. 10, thus, involves a positive work pulling force applied to a first grip; a negative work pulling force applied to a second grip; a positive work pulling force applied to the second grip; and, finally, a negative work pulling force applied to the first grip. One of ordinary skill in the art will recognize that the flywheel and grip variations described in connection with FIGS. 1–9 above can be incorporated into the inertia exercise device of FIG. 10. One of ordinary skill will also recognize many variations with respect to the frame and arrangement of FIG. 10.

In a preferred embodiment, the flywheel 10 illustrated in FIG. 10 is a disk shaped to have greater mass on or near its outer diameter. Most preferably, a diameter of the flywheel has a generally "dog-bone" shaped cross-section. The preferred flywheel has a radius in the range of 2 to 15 inches and a weight in the range of 2 to 30 pounds. In a most preferred embodiment, the flywheel 10 of FIG. 10 has a radius in the range of 6 to 8 inches and a weight in the range of 10 to 12 pounds.

Figure 11:
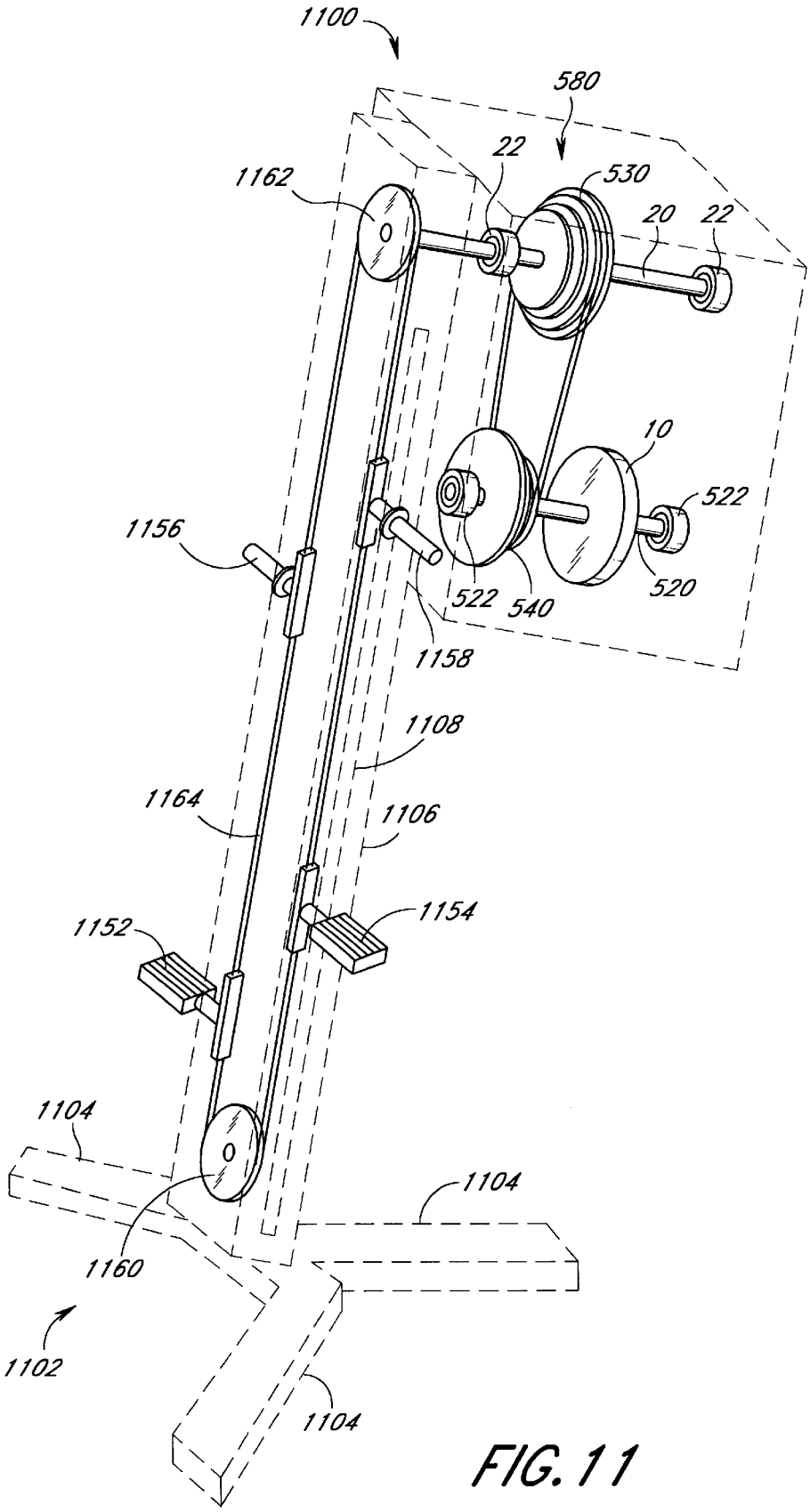
FIG. 11 is a perspective view of the inertial resistance exercise device incorporating the dual-axle flywheel assembly shown in FIG. 5 without a spool and illustrating a climbing exercise configuration.

As seen in FIG. 11, a flywheel mechanism similar to that shown in FIG. 9 may be incorporated into an inertia exercise device 1100 (shown in phantom) to provide a climbing exercise. The climbing exercise machine 1100 includes a base 1102 that supports the exercise machine 1100 on a generally flat surface such as a floor. The base 1102 includes three outwardly extending arms 1104 which are located in generally the same plane to provide a tripod support for the exercise machine 1100. Generally vertically extending from the base 1102 and proximate the interconnection of the arms 1104, is a frame 1106. Located within the frame 1106, proximate the base 1102, is a first sprocket 1160. Located proximate the other end of the frame 1106 is a second sprocket 1162. These sprockets 1160 and 1162 are interconnected by a chain 1164, cog belt or other similar substantially inelastic connection.

The frame 1106 includes longitudinally extending openings or slots 1108 formed on opposing sides of the frame 1106. Extending through the slots 1108 are left and right pedals 1152 and 1154, and left and right handles 1156 and 1158, respectively, which are attached to the chain 1164. The pedals 1152 and 1154 are located proximate the base 1102 of the exercise machine 1100, and the handles 1156 and 1158 are located proximate the other end of the frame 1106. One skilled in the art, of course, will understand the climbing exercise machine may be used with any of the embodiments of the invention.

The climbing exercise machine may be similar to that disclosed in U.S. Pat. No. 5,040,785 which issued Aug. 20, 1991, entitled "Climbing Exercise Machine", and invented by the same inventor as the present invention. The disclosure of U.S. Pat. No. 5,040,785 is hereby incorporated by reference. The climbing exercise machine may also be similar to that disclosed in U.S. Pat. No. 5,492,515 which issued Feb. 20, 1996, entitled "Climbing Exercise Machine" and invented by the same inventor as the present invention. The disclosure of U.S. Pat. No. 5,492,515 is hereby incorporated by reference. Additionally, the climbing exercise machine may be similar to that disclosed in pending application Ser. No. 08/576,130 which was filed on Dec. 21, 1995, entitled "Climbing Exercise Machine" and invented by the same inventor as the present invention. The disclosure of pending application Ser. No. 08/576,130 is hereby incorporated by reference.

As shown in FIG. 11, the sprocket 1162 is preferably connected to a rotatable axle 20. The axle 20 preferably rotates within bearings 22. A second axle 520 is preferably located parallel to the first axle 20. This second axle 520 is preferably rotatably mounted within bearings 522. A flywheel 10 is mounted on the second axle 520. The first axle 20 and the second axle 520 are connected by a synchronizing assembly 580. The synchronizing assembly has one or more sprockets 530 mounted on the first axle 20 and one or more sprockets 540 mounted on the second axle. The sprockets 530 and 540 are engaged with a chain 550, cog belt or other substantially inelastic connection. One of ordinary skill in the art will understand that the number of sprockets and diameters of the sprockets may depend upon the desired range of exercise difficulty.

As an alternative embodiment, the synchronization assembly may include a variable gear ratio transmission (not shown). The transmission allows the axles 20 and 520 to be interconnected to provide a different and adjustable range of motion between the axles. The transmission may be any of a large number of well known variable transmissions. The transmission eliminates the need for the chain 550 to interconnect the sprockets 530 and 540, and it maintains the synchronized movement of the handles and pedals.

In a preferred embodiment, the flywheel 10 illustrated in FIG. 11 is a disk shaped to have greater mass on or near its outer diameter. Most preferably, a diameter of the flywheel has a generally "dog-bone" shaped cross-section. The preferred flywheel has a radius in the range of 2 to 12 inches and a weight in the range of 4 to 15 pounds. In a most preferred embodiment, the flywheel 10 of FIG. 11 has a radius in the range of 4 to 5 inches and a weight in the range of 6 to 12 pounds.

In a preferred embodiment, the synchronizing assembly 580 illustrated in FIG. 11 consists of sprockets having diameters in the range of 2 to 10 inches and having diameter ratios between the two axles ranging from 2 to 10.

Figure 12:
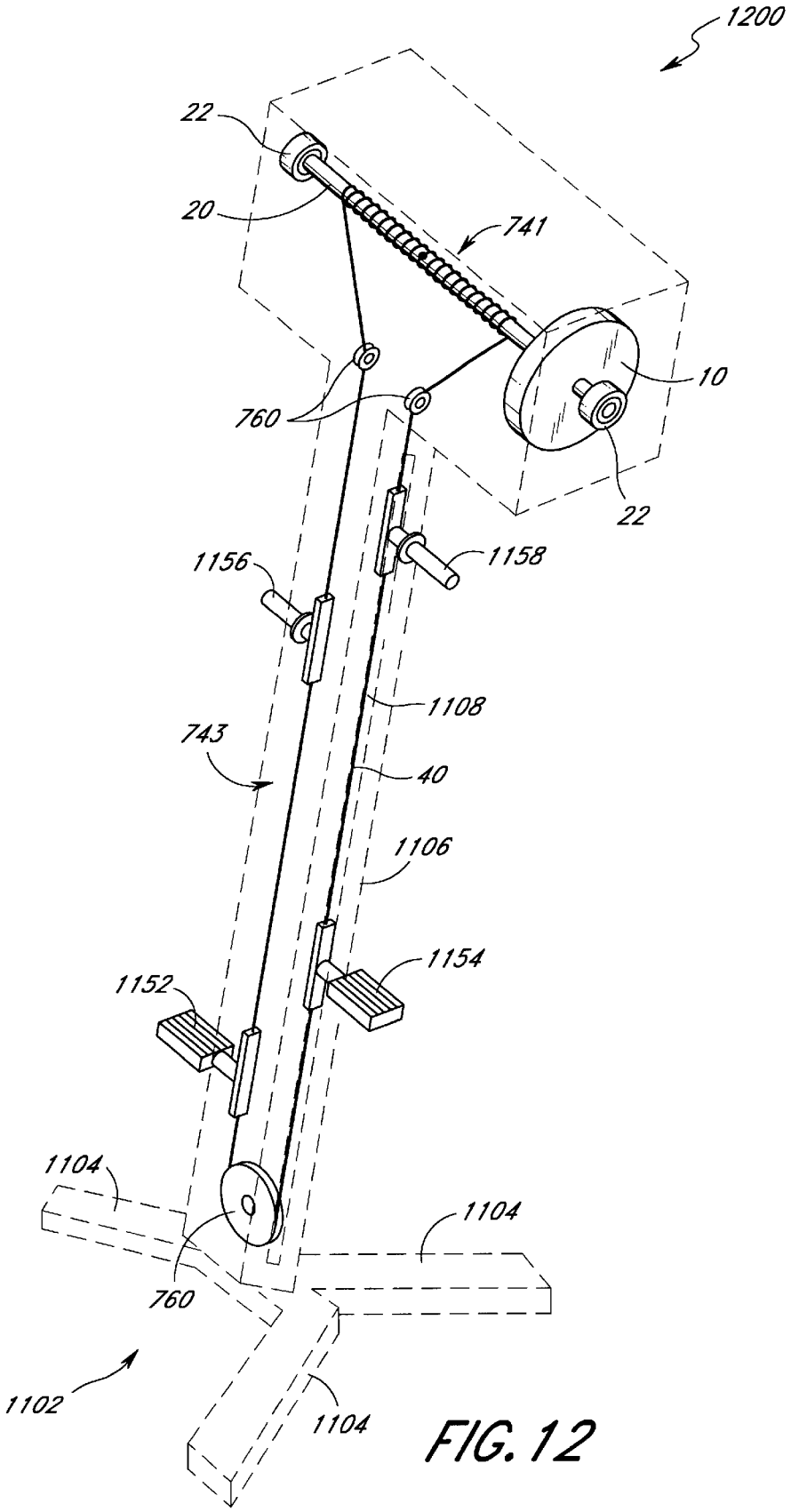
FIG. 12 is a perspective view of the inertial resistance exercise device incorporating the flywheel assembly illustrated in FIG. 7 and illustrating a climbing exercise configuration.

FIG. 12 illustrates an alternative embodiment of the climbing exercise machine incorporating a flywheel mechanism similar to that shown in FIG. 7. In this embodiment the center portion 743 of a line 40 is supported by sprockets 760. A coiled portion 741 of the line 40 is wrapped around an axle 20. The axle 20 is supported by bearings 22, and mounted on the axle 20 is a flywheel 10. Extending through slots 1108 in the frame 1106 are left and right pedals 1152 and 1154 and left and right handles 1156 and 1158, respectively, which are attached to the line 40. The pedals 1152 and 1154 are located proximate the base 1102 of the exercise machine 1100, and the handles 1156 and 1158 are located proximate the other end of the frame 1106.

In operation of either embodiment of the climbing machine, as illustrated in FIGS. 11–12, the movement of the foot pedals 1152 and 1154, and the hand pedals 1156 and 1158 allow the user to exercise. In one preferred embodiment of the invention, the handles and pedals preferably move in coordinated and synchronized movement such that when the handle and pedal on one side of the machine move in one direction, the handle and pedal on the opposite side of the machine move in the opposite direction. Thus, while the handle and pedal are moving upwardly on one side of the machine, the handle and pedal are moving downwardly on the other side of the machine. Additionally, both handles 1156 and 1158 are moving at the same velocity because they are interconnected by the chain 1164 shown in FIG. 11 or the line 40 shown in FIG. 12. Likewise, both pedals 1152 and 1154 are moving at the same velocity.

Referring to FIG. 11, the upward and downward movement of the handles 1156 and 1158 and pedals 1152 and 1154 causes periodic movement of the chain 1164 and periodic rotation of the sprocket 1162. The rotation of the sprocket 1162 causes the axle 20 and sprocket 530 to rotate. The rotation of the sprocket 530 causes the chain 550 and sprocket 540 to rotate. This rotation accelerates the flywheel 10 whose inertia causes an exercise producing resistance to the movement of the handles and pedals. Referring to FIG. 12, the upward and downward movement of the handles 1156 and 1158 and pedals 1152 and 1154 causes periodic movement of the line 40 and periodic rotation of the axle 20. This rotation accelerates the flywheel 10 whose inertia causes an exercise producing resistance to the movement of the handles and pedals.

One of ordinary skill in the art will understand that a wide variety of climbing machines may be utilized with the present invention. For example, climbing machines with a cross crawl or homolateral movement may also be utilized. By eliminating the handles and shortening the frame of the exercise device of FIG. 12, it becomes a stepper exercise machine. By adding a seat and inclining the frame of the exercise device of FIG. 12, it becomes an inclined or recumbent linear exercise machine. The climbing machines previously disclosed and incorporated by reference in connection with FIG. 11 may also be utilized in connection with the exercise device of FIG. 12.

In a preferred embodiment, the flywheel 10 illustrated in FIG. 12 is a disk shaped to have greater mass on or near its outer diameter. Most preferably, a diameter of the flywheel has a generally "dog-bone" shaped cross-section. The preferred flywheel has a radius in the range of 2 to 12 inches and a weight in the range of 5 to 25 pounds. In a most preferred embodiment, the flywheel 10 of FIG. 12 has a radius in the range of 6 to 8 inches and a weight in the range of 12 to 15 pounds.

The inertial exercise apparatus and method according to the present invention has been disclosed in detail in connection with the preferred embodiments, but these embodiments are disclosed by way of examples only and are not to limit the scope of the present invention, which is defined by the claims that follow. One of ordinary skill in the art will appreciate many variations and modifications within the scope of this invention.

What is claimed:

1. An exercise apparatus comprising:

a rotatably mounted axle;

a flywheel rotatably communicating with said axle, said flywheel having a mass sufficient to provide significant inertial resistance to rotational acceleration;

a line having a first end and a second end, said first end attached to said axle, said line having a first position wherein a portion of said line is wrapped about a portion of said axle, and a second position wherein said line is substantially unwrapped from said axle, wherein a force applied to said line in said first position creates an accelerating torque on said axle causing said axle to rotate as said line generally moves from said first position towards said second position; and a line guide spaced from said axle and in communication with the line, the line guide adapted to define an angle of the line relative to a longitudinal axis of the axle, said line guide positioned so that said angle is less than about 45° at said second position.

2. The exercise apparatus of claim 1 wherein a force applied to said line in said second position and when said axle is rotating creates a decelerating torque on said axle as said line generally moves from said second position towards said first position.

3. The exercise apparatus of claim 2 wherein acceleration of said axle exercises a muscle group and deceleration of said axle exercises said muscle group.

4. The exercise apparatus of claim 3 wherein said axle rotates in a first direction to exercise said muscle group during a first repetition and said axle rotates in a second direction to exercise said muscle group during a second repetition.

5. The exercise apparatus of claim 1 further comprising a spool axially mounted to said axle.

6. The exercise apparatus of claim 5 wherein said spool is mounted to said axle with a narrow end proximate said first end of said line and a wide end distal said first end of said line.

7. The exercise apparatus of claim 5 wherein, for a particular force applied to said line, said accelerating torque generally decreases as said line generally moves from said first position towards said second position and said decelerating torque generally increases as said line generally moves from said second position towards said first position.

8. The exercise apparatus of claim 1 wherein a generally constant force on said line generally continuously changes the acceleration of said axle.

9. The exercise apparatus of claim 1 wherein a force on said line is resisted by a generally constant force.

10. The exercise apparatus of claim 1, wherein an unwrapped angle is defined between the longitudinal axis of the axle and said line when said line is in said second position, and wherein said line guide is adjustable between multiple locations so that said unwrapped angle is adjustable through a range of acute angle.

11. The exercise apparatus of claim 1 further comprising a spool axially mounted to said axle.

12. The exercise apparatus of claim 11 wherein said line guide is located such that a portion of said line wraps about a portion of said spool.

13. An exercise apparatus comprising:

a rotatably mounted axle;

a flywheel in communication with said axle and adapted to rotate with the axle;

a line having a first portion and a first wound position wherein said first portion is at least partially wound about said axle in a first winding direction, and a second wound position wherein said first portion is at least partially wound about said axle in a second winding direction substantially opposite the first winding direction; and a line guide spaced from the axle and communicating with said line, said line guide and line adapted so that said line wraps around said axle in a substantially single-layer helical pattern in both the first and second winding directions, wherein said line guide is movable relative to said axle.

* * * * *

UNITED STATES PATENT AND TRADEMARK OFFICE

CERTIFICATE OF CORRECTION

PATENT NO. : 6,283,899 B1
DATED : September 4, 2001
INVENTOR(S) : Richard D. Charnitski It is certified that error appears in the above-identified patent and that said Letters Patent is hereby corrected as shown below:

Column 18,
Line 40, the following claims are added:

14. The exercise apparatus of Claim 13, wherein the line is adapted to accept a user-applied force.

15. The exercise apparatus of Claim 13, wherein the line is substantially inelastically connected to the drive member.

16. The exercise apparatus of Claim 13, wherein moving said line guide alters said substantially helical pattern of said line on said axle.

17. An exercise apparatus comprising:

a rotatably mounted axle;

a weighted flywheel adapted to rotate with said axle;

a line having a first end and a second end, said first end attached to said axle, said line having a first position wherein a portion of said line is wrapped about a portion of said axle and a second position wherein said line is unwrapped from said axle, wherein a force applied to said line in said first position creates an accelerating torque on said axle causing said axle to rotate as said line generally moves from said first position towards said second position;

a spool axially mounted to said axle, said spool having an axial taper; and a line guide spaced from said axle and in communication with the line, the line guide adapted to define an angle of the line relative to a longitudinal axis of the axle.

18. The exercise apparatus of Claim 17 wherein said spool is mounted to said axle with a narrow end proximate said first end of said line and a wide end distal said first end of said line.

19. The exercise apparatus of Claim 18 wherein, for a particular force applied to said line, said accelerating torque generally decreases as said line generally moves from said first position towards said second position and said decelerating torque generally increases as said line generally moves from said second position towards said first position.

20. An exercise apparatus comprising:

a rotatably mounted elongate axle having a portion of increased diameter, a portion of reduced diameter, and a transition portion therebetween, the transition portion having a generally decreasing diameter along its length from the increased diameter portion to the reduced diameter portion;

a flywheel communicating with the axle and adapted to rotate with the axle;

a line having a first wound position wherein at least a portion of the line is wound about the axle in a first winding direction, and an unwound position wherein an unwound angle is defined between a portion of the line adjacent the axle and a longitudinal axis of the axle;

a line guide spaced apart from the axle and communicating with the line, the line guide being adjustable so that a distance between the line guide and the portion of reduced diameter is selectively

UNITED STATES PATENT AND TRADEMARK OFFICE

CERTIFICATE OF CORRECTION

PATENT NO. : 6,283,899 B1
DATED : September 4, 2001
INVENTOR(S) : Richard D. Charnitski It is certified that error appears in the above-identified patent and that said Letters Patent is hereby corrected as shown below:

variable;

wherein a force applied to the line when in the first wound position causes the axle to rotate and imparts rotational energy to the flywheel as the line moves from the first wound position towards the unwound position, and the rotational energy of the flywheel causes a portion of the line to wind about the axle in a second winding direction opposite the first winding direction after the unwound position is attained so that a force applied to the line is opposed by the rotational energy in the flywheel.

21. The exercise device of Claim 20, wherein the axle has a substantially untracked surface.

22. An inertial force-based exercise device comprising:

an elongated axle mounted for substantially free rotational movement;

a line attached to said axle and positioned to wrap around said axle when the axle is turned in one direction and to unwrap from said axle when the axle is turned in the other direction;

a line guide spaced from said axle, said line passing through said line guide;

a significant inertial body in rotational communication with said axle, said inertial body having a mass sufficient to provide significant inertial resistance to rotational acceleration;

whereby when a force is applied to the line at a point beyond the line guide in a direction away from the axle the line is unwrapped from the axle and resistance is provided by the inertial body's inertial resistance to rotational acceleration, whereby when the axle continues to rotate after the line transitions through an unwrapped condition, the line is wrapped around said axle in a direction substantially opposite the immediately previous wrapped direction and a force is applied by the inertial body on the line in a direction toward the axle;

said guide positioned with respect to said axle such that an angle between the rotational axis of the axle and the line when the line is unwrapped is about 45° or less.

23. The exercise device of Claim 22, wherein the elongated axle is tapered along its length.

24. The exercise device of Claim 23, wherein the elongated axle has a substantially conical portion.

25. The exercise device of Claim 23, wherein the elongated axle has a substantially untracked surface.

26. The exercise device of Claim 22, wherein the elongated axle is greater than about six inches long.

27. The exercise device of Claim 22, wherein the elongated axle is oriented substantially vertically.

28. The exercise device of Claim 22, wherein the line guide is adjustable with respect to said axle.

29. The exercise device of Claim 22, wherein the axle, line guide and line are adapted so that the line is wrapped about the axle in a single-layer substantially helical winding pattern.

Signed and Sealed this

Sixteenth Day of September, 2003

JAMES E. ROGAN
*Director of the United States Patent and Trademark Office*